United States Patent [19]

Starck

[11] Patent Number: 4,948,953

[45] Date of Patent: Aug. 14, 1990

[54] HOLDING PART FOR PTC COMPONENTS

[75] Inventor: Roland Starck, Bellheim, Fed. Rep. of Germany

[73] Assignee: Fritz Eichenauer GmbH & Co. KG, Kandel, Fed. Rep. of Germany

[21] Appl. No.: 337,083

[22] Filed: Apr. 12, 1989

[30] Foreign Application Priority Data

Jan. 26, 1989 [DE] Fed. Rep. of Germany ..... 3902205

[51] Int. Cl.[5] ..... H01C 7/02

[52] U.S. Cl. ..... 219/504; 219/541; 338/328; 361/388

[58] Field of Search ..... 219/504, 505, 539, 541; 338/22 R, 328

[56] References Cited

U.S. PATENT DOCUMENTS 2,606,986 8/1952 Sweger ..... 338/23
4,242,567 12/1980 Carter ..... 219/225
4,327,282 4/1982 Naverth ..... 219/541

FOREIGN PATENT DOCUMENTS 0023644 2/1981 Fed. Rep. of Germany ..... 219/505

*Primary Examiner*—Roy N. Envall, Jr.
*Attorney, Agent, or Firm*—Antonelli, Terry, Stout & Kraus

[57] ABSTRACT

For the better handling of PTC components during the assembly of a corresponding heating arrangement, in the case of a holding part for PTC components with an insulating frame and at least one contact plate, a contact plate is firmly connected to the insulating frame (12).

9 Claims, 2 Drawing Sheets

HOLDING PART FOR PTC COMPONENTS

BACKGROUND OF THE INVENTION

The invention relates to a holding part for PTC components with an insulating frame and at least one contact plate.

PTC heaters generally have several juxtaposed PTC components preferably arranged in a row and covered by common contact plates, on whose sides remote from the PTC components are optionally arranged insulating plates. This arrangement is held together in any appropriate way, e.g. by clips, terminal strips, inserting in an envelope and the like. Reference is made in exemplified manner to DE-OS 28 45 965, DE-OS 28 45 894 and DE-OS 29 48 591.

After joining together the PTC components on a contact plate and applying the further contact plate, it is very difficult to handle this structure, because there is a risk of the PTC components laterally slipping out between the two plates before introduction into a casing, or before they are reliably held together by a clamping device.

The aim underlying the present invention essentially resides in a holding part of PTC components for reliably holding providing the PTC components prior to the assembly of the heating arrangement in such a way that they cannot drop out of a sandwich arrangement.

According to the invention this problem is solved by a holding part and an insulating frame, as well as at least one contact plate in that the latter is firmly connected to the insulating frame. In order to achieve a reliable holding of the PTC components during handling, it is not sufficient to have an insulating frame surrounding the narrow sides of the PTC components because, even if a substrate is held against the same from below, e.g. in the form of a contact plate, there is a risk of the insulating frame and the substrates sliding relative to one another, so that once again a single PTC component can drop out of the frame. Thus, according to the invention, the contact plate and insulating frame are firmly interconnected. The term firmly interconnected here means that they cannot be detached without considerable effort and in particular that they cannot be loosened from one another by chance or slide relative to one another. It would fundamentally also be possible to use a threaded coupling. However, preferably the contact plate is riveted in the vicinity of one of its ends to the insulating frame. The firmly fitted contact plate is positioned on one side of the frame, so that the individual PTC components can be inserted in the frame part from the opposite side and are prevented from dropping out by the contact plate. The further contact element, such as a further contact plate or a profile contact body with a U-shaped cross-section can then be placed on the side of the frame and the inserted PTC components facing the contact plate firmly connected to the frame. It is then possible to position further cover elements, such as stable cover plates or the like which protect the insulating member up to the time of further assembly, namely the optional placing of insulating plates on the contact plate. According to a further development of the holding part, a connecting tongue is riveted to the contact plate and/or a contact tongue is constructed in one piece with the contact plate. If the contact plate is already firmly connected to the insulating frame, it is then also appropriate to construct in one piece therewith a connecting tongue, namely that connected to the contact plate and/or to firmly connect it, e.g. by riveting to the insulating frame.

If a relative pivoting of frame and contact plate could also be prevented by two rivets, which are either juxtaposed in one end region or are in each case located at one end region, then it is advantageous to prevent pivoting of that end of the contact plate which is not firmly connected to the insulating frame and also to prevent any bending out of its plane, but not to completely fix the same, so that the end can perform compensating movements, e.g. under compressive forces and temperature changes. In order to achieve this, according to another preferred development, on the end of the insulating frame opposite to the fixed connection between the contact plate and the insulating frame is formed a clip raised out of the plane thereof and which engages over the contact plate end opposite to the fixing point and in particular the contact plate is free between its end regions.

In order to prevent a giving way or yielding of the contact plate under compressive forces exerted during the further assembly of a PTC heater, to ensure a good heat transfer and therefore to obtain the same, according to a preferred development the contact plate is made from flexible sheeting. It is then preferred that the contact plate is bent in convex manner and pretensioned with respect to the frame part. As a result in the case of locally exerted forces, i.e. not exerted over the entire length of the frame and contact plate and which essentially act in the central region, an adequate pressing action is obtained and therefore a sufficiently good contact between the contact plate and the PTC components over the entire length.

According to a further development in the vicinity of the fixing point on the frame side facing the contact plate are provided cams extending out of the plane thereof. It is thus possible to prevent an axial displacement of insulating plates resting on the contact plate side remote from the frame. According to another construction the frame has transverse webs. As a result the individual PTC components can be individually grasped and received in recesses within the frame part.

The invention is described in greater detail hereinafter relative to non-limitative embodiments and the attached drawings, wherein show:

BRIEF DESCRIPTION OF THE DRAWINGS

FIG. 4 is a vertical cross-sectional view taken along the line IV—IV in FIG. 1;

DETAILED DESCRIPTION

Figure 1:
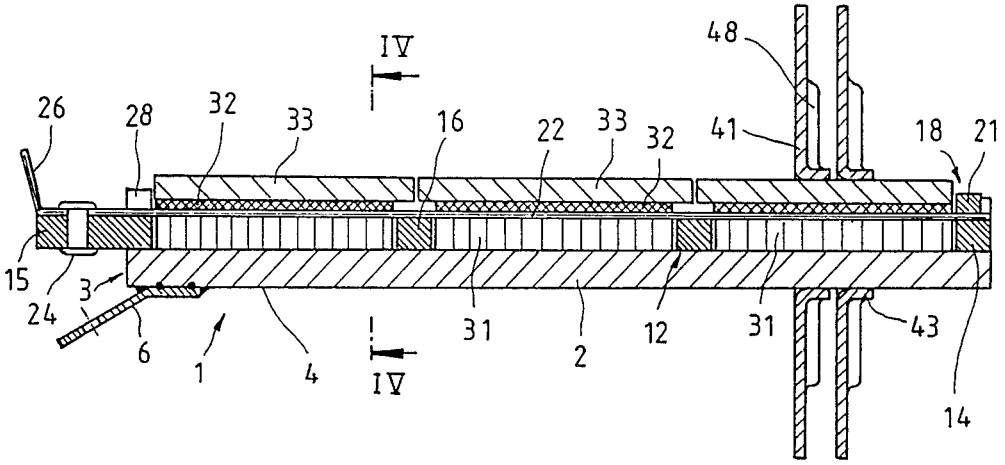
FIG. 1 is a vertical longitudinal cross-sectional view through a heating device constructed in accordance with the present invention taken along the line I—I in FIG. 4.

Referring now to the drawings wherein like reference numerals are used throughout the various views to designate like part and, more particularly, to FIG. 1, according to this figure, a heating device generally designated by the reference numeral 1 includes an aluminum U-shaped profile 2 preferably having a hardness F28 and a thermal stability over 400° C. A connecting tongue 6 is fixed, for example, by rivetting or spot welding, to an outer wall 4 of one end generally designated by the reference numeral 3 of the U-shaped profile 2.

Figure 2:
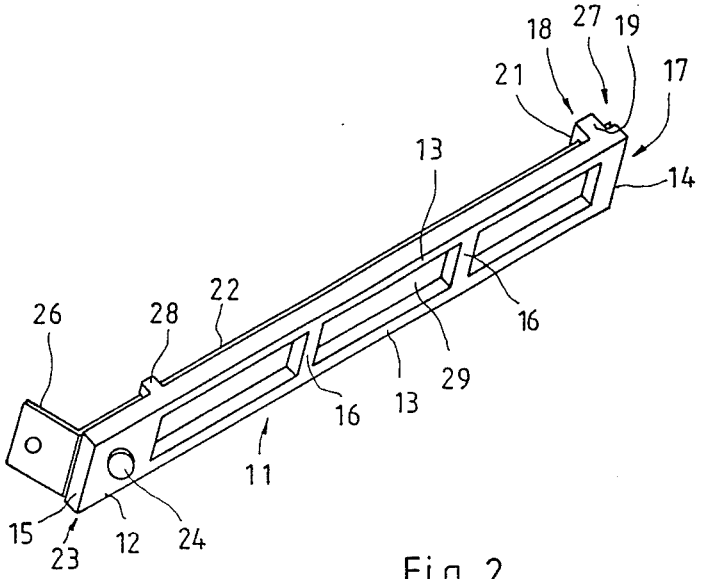
FIG. 2 is a perspective view of a holding part of PTC components used in the heating device of FIG. 1.
Figure 5:
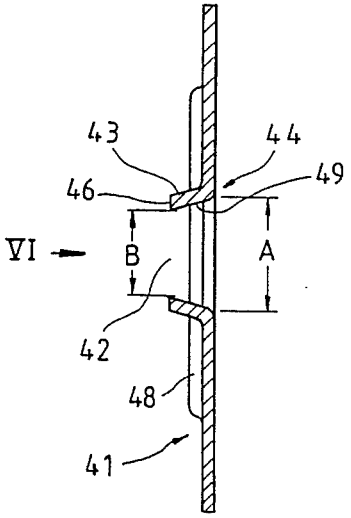
FIG. 5 is a cross-sectional view through a lamella taken along the line V—V in FIG. 6.
Figure 6:
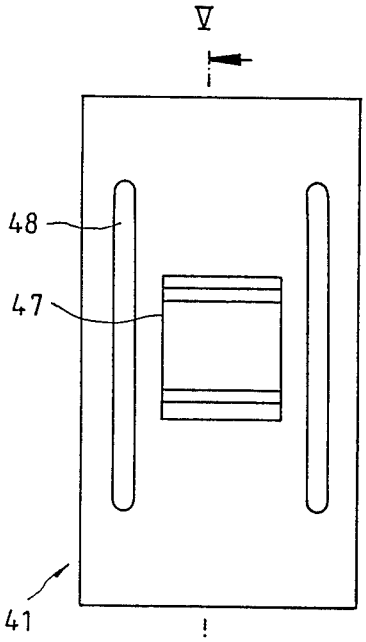
FIG. 6 is a view of a lamella taken in a direction of the arrow VI in FIG. 5.

A holding part generally designated by the reference numeral 11, as shown in detail in FIG. 2 is located in the U-shaped profile 2, with the holding part 11 having a frame part generally designated by the reference numeral 12 made from an insulating material, such as Rayton. The frame part 12 is formed from longitudinal legs 13, transverse legs 14, 15 constructed on the end faces thereof and also, in the represented embodiment, from transverse webs 16. To one end face generally designated by the reference numeral 17, it also has a U-shaped clip 18 raised out of its plane and which is constructed with its legs 19 in one piece on the longitudinal leg 13 of frame part 12, while web 21 extends at right angles over the width of frame part 12, over which extends a contact plate 22. In the represented embodiment the contact plate 22 is constructed as a spring plate. In the end region generally designated by the reference numeral 23 of frame part 12 remote from the end face 17 is is firmly connected thereto, e.g. rivetted thereto by a rivet 24. It is simultaneously possible to rivet a further connecting tongue 26. The connecting tongue 26 could be constructed in one piece with the contact plate 22. On an end face generally designated by the reference numeral 27 remote from connecting tongue 26, contact plate 22 engages under web 21 of clip 18 an is thus held by the latter at the end face 27. Contact plate 22 is preferably prebent in convex manner towards frame 12 and, consequently, pretensioned. In the vicinity of the end region 23 and on the same side facing contact plate 22 on which clip 18 is located, the frame 12 has, on its two longitudinal legs 13, two cams 28, which in the longitudinal direction to the contact plates longitudinally secure between cams 28 and clip 18 insulating parts placed on its side remote from the frame 12.

Figure 4:
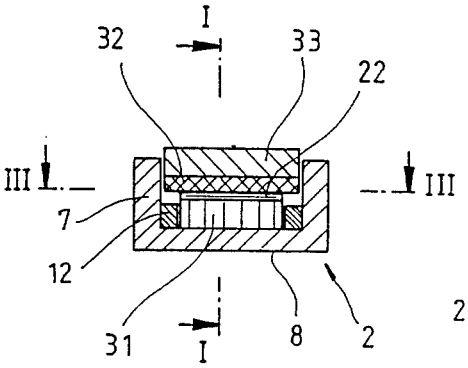
FIG. 4 is a vertical cross-sectional view taken along the line III—III in FIG. 4.
Figure 3:
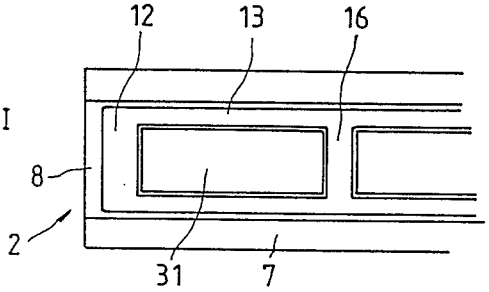
FIG. 3 is a cross-sectional view taken along the line III—III in FIG. 4.

PTC components 31 (FIGS. 1, 3, 4) are inserted in the recesses 29 of frame 12 bounded by legs 13, 14, 15 and webs 16. Individual insulating parts 32 forming an insulating support are place on the contact plate 22. Insulating parts 32 have a length corresponding to the PTC components 31, and a width corresponding to the internal spacing of legs 7 of U-shaped profile 2. The insulating parts are preferably made from a heat conducting electrically insulating metal oxide, such as, for example magnesium, barium or, preferably, aluminium oxide. Insulating parts also carry stable cover plates 33, made, for example, from aluminium, whose width and length correspond to the width and length of insulating parts 32. The height of the arrangement formed by PTC component 31, contact plate 22 and insulating part 32 is slightly below the internal length of leg 7 of U-profile 2, while the height of the aforementioned parts, plus the height of the cover plate 33, is slightly above the the internal length of leg 7.

The aforementioned heating unit carries, in frictionally engaging manner, lamellas generally designated by the reference numeral 41 for delivering heat to the surrounding air or gas. For this purpose, the lamellas 41 have an opening 42, which is inter alia defined by two facing tongues 43, which are bent out of the main plane of lamellas 41. In the transition region generally designated by the reference numeral 44 of tongues 43 to the main part of lamellas 41, the spacing A thereof is at least the height of the heating unit of the leg 8 of U-shaped profile 2, a PTC component 31, contact plate 22, insulating part 32 and cover plate 33, while the internal spacing D of end faces 46 of tongues 43 is below the height of the aforementioned arrangement and therefore less than spacing A, for as long as the lamella 41 is not moved over the above-defined heating unit. The lamellas 41 are made from aluminium sheeting and, for reinforcement purposes, reinforcing grooves 48 run parallel to the longitudinal edges 47 and are stamped out of the main plane of lamellas 41. This leads to a slight increase in the heat delivery surface, but it is important that the reinforcement ensures that the lamellas 41 do not flutter when air flows through, which could lead to noise being produced. Thus, the lamellas 41 are passed in frictionally engaging manner over the heating unit and rest thereon under clamping engagement. Due to the fact that, apart from the individual PTC components 31, also the insulating plates 32 and cover plates 33 are constructed in split manner, the lamellas 41 lead to a good thermal contact between the PTC components 31 and the web 8 of U-shaped profile 2 and, via contact plate 22, with the insulating part 32 and the cover plates 33 located above it. As a result of the clamp fit, the side 49 of tongues 43 facing the heating unit is pressed substantially flat against the top of cover plate 43 or the outside of the web 8 an engage on these parts, so that a reliable heat transfer to the lamellas 41 and a deliver of heat to the air are ensured. The tongues 46, bent out of the plane of the lamellas 41, ensure a spacing of the lamellas from one another, i.e. they form spacers, which avoids close engagement between the lamellas 41. A clearly defined relative spacing is maintained between them. Whereas, only two lamellas 41 located on the heating unit are shown in FIG. 1, a number of such lamellas 41 are juxtaposed thereon, so that a radiator with a plurality of lamellas 41 is formed.

The overall arrangement is assembled as follows. First, the holding part 11 constituted by frame part 12 and contact plate 22 are firmly interconnected by rivetting of the two parts and simultaneous rivetting of the connecting tongue 26. The PTC components 31 are then inserted in frame part 12 from the side remote from contact plate 22 and are held by contact plate 22 firmly connected to frame part 12, so that it is not possible for the PTC components 31 to drop out. The sectionally U-shaped profile is then placed on the side of frame part 12 remote from contact plate 22. The inside of its web 8 engages with PTC components 31 and legs 7 engage laterally over the frame 12, particularly its longitudinal leg 13 and cover plate 22. The unit is then turned by 180° , so that the web 8 of profile part 2 is directed downwards and now carries holding part 11 and the PTC cmponents in the frame 12, while the legs 7 project over holding part 11 in the upwards direction. Between legs 7, on contact plate 22 are placed the insulating plates 32 and on the latter the cover plates 33. Lamellas 41 are then engaged on the resulting unit and as a result of the clamping sides thereof they bring about a firm arrangement, which can no longer fall apart.

I claim:

1. Holding part for PTC components, the holding part comprising an insulating frame, at least one contact plate, means for firmly connecting the at least one contact plate to the insulating frame at a point of firm connection at one end of the insulating frame, and wherein an end of the insulating frame opposite the point of firm connection between the insulating frame and the at least one contact plate includes clip means raised out of a plane of the at least contact plate for engaging the end of the insulating frame opposite the point of firm connection.

2. Holding part according to claim 1, wherein said means for firmly connecting includes rivet means arranged in a vicinity of end faces of the at least one contact plate.

3. Holding part according to claim 2, further comprising a connecting tongue means firmly affixed to the at least one contact plate.

4. Holding part according to claim 1, further comprising a connecting tongue means integrally formed in one-piece with the at least one contact plate.

5. Holding part according to one of claims 1 or 2, wherein an intermediate portion of the at least one contact plate between the opposed ends thereof is unrestrained.

6. Holding part according to one of claims 1 or 2, wherein the at least one contact plate is made from flexible sheet metal.

7. Holding part according to one of claims 1 or 2, wherein the at least one contact plate pre-bent towards the frame part so as to provide a predetermined tensioning in the holding part.

8. Holding part according to one of claims 1 or 2, wherein cam means extending out of a plane of the insulating frame are provided on a side of the insulating frame at least in an area of the point of firm connection for securing the at least one contact plate to the insulating frame.

9. Holding part according to one of claims 1 or 2, wherein the insulating frame includes transverse web means for defining recesses in the insulating frame for accommodating the PTC components.

* * * * *